US008985161B2

(12) United States Patent
Lorenz et al.

(10) Patent No.: US 8,985,161 B2
(45) Date of Patent: Mar. 24, 2015

(54) METHOD OF OPERATING A BEVERAGE BOTTLING OR CONTAINER FILLING ARRANGEMENT WITH A FILLING VOLUME CORRECTING APPARATUS

(75) Inventors: Karl Lorenz, Niederhausen (DE); Achim Kunz, Simmern (DE)

(73) Assignee: KHS GmbH, Dortmund (DE)

( * ) Notice: Subject to any disclaimer, the term of this patent is extended or adjusted under 35 U.S.C. 154(b) by 1022 days.

(21) Appl. No.: 12/343,912

(22) Filed: Dec. 24, 2008

(65) Prior Publication Data

US 2009/0159150 A1 Jun. 25, 2009

Related U.S. Application Data

(63) Continuation-in-part of application No. PCT/EP2007/005400, filed on Jun. 20, 2007.

(30) Foreign Application Priority Data

Jun. 27, 2006 (DE) ..... 10 2006 029 490

(51) Int. Cl.
*B67C 3/28* (2006.01)
*B65B 3/34* (2006.01)
(Continued)

(52) U.S. Cl.
CPC . *B67C 3/288* (2013.01); *B65B 3/34* (2013.01); *B67C 3/007* (2013.01)
USPC ..... 141/1; 141/188; 141/196; 53/503; 222/639

(58) Field of Classification Search
CPC ..... B67C 3/20; B67C 3/22; B67C 3/28; B67C 3/287; B67C 3/288; B65B 3/30; B65B 3/34
USPC ..... 53/467, 471, 473, 266.1, 267, 281, 286, 53/503; 222/639, 640, 643, 71, 72; 141/188, 196
See application file for complete search history.

(56) References Cited

U.S. PATENT DOCUMENTS 3,651,836 A * 3/1972 Johnson ..... 141/103
3,708,088 A * 1/1973 Lesher ..... 222/595
(Continued)

FOREIGN PATENT DOCUMENTS

DE 41 17 287 12/1992
DE 103 01 844 1/2003
(Continued)

OTHER PUBLICATIONS

International Search Report PCT/EP2007/005400 and English translation thereof, mailed Oct. 9, 2007, 6 pages.
(Continued)

*Primary Examiner* — Stephen F Gerrity
(74) *Attorney, Agent, or Firm* — Nils H. Ljungman & Associates

(57) ABSTRACT

Method of controlling a container filling machine comprising a plurality of filling elements. Each of the filling elements has a flow measuring device which is used to measure the volume of filling material dispensed from its filling element. During filling, the time that a first filling element is open to dispense a predetermined volume of filling material is measured. A second filling element is then opened for essentially the measured time to thereby dispense essentially the predetermined volume of filling material into a second container. As an alternative, a time may be calculated from the measured times of a plurality of filling elements, which calculated time may be used to determine for how long another filling element is opened.

12 Claims, 3 Drawing Sheets

(51) Int. Cl.

| | |
|---|---|
| ***B67C 3/20*** | (2006.01) |
| ***B65B 3/30*** | (2006.01) |
| ***B67C 3/00*** | (2006.01) |

(56) References Cited

U.S. PATENT DOCUMENTS

| | | | | | |
|---|---|---|---|---|---|
| 3,760,852 | A | * | 9/1973 | Waxlax | 141/40 |
| 4,206,788 | A | * | 6/1980 | Susaki et al. | 141/1 |
| 4,386,635 | A | * | 6/1983 | Ahlers et al. | 141/6 |
| 4,408,640 | A | * | 10/1983 | Voza | 141/1 |
| 4,476,534 | A | * | 10/1984 | Schlosser | 700/231 |
| 4,557,301 | A | * | 12/1985 | Jorss | 141/5 |
| 4,651,788 | A | * | 3/1987 | Grosskreuz et al. | 141/83 |
| 4,860,804 | A | * | 8/1989 | Yamaguchi et al. | 141/94 |
| 5,105,859 | A | * | 4/1992 | Bennett et al. | 141/188 |
| 5,273,082 | A | * | 12/1993 | Paasche et al. | 141/6 |
| 5,730,323 | A | * | 3/1998 | Osborne | 222/55 |
| 5,823,234 | A | * | 10/1998 | Boertz | 141/67 |
| 5,957,171 | A | * | 9/1999 | Matsuo | 141/83 |
| 6,148,877 | A | * | 11/2000 | Bethke | 141/103 |
| 6,378,575 | B1 | * | 4/2002 | Marchau | 141/234 |
| 6,761,191 | B2 | * | 7/2004 | Rosen et al. | 141/91 |
| 2004/0083814 | A1 | * | 5/2004 | Lehmann et al. | 73/588 |
| 2004/0232162 | A1 | * | 11/2004 | Zimmermann et al. | 222/63 |
| 2005/0150571 | A1 | * | 7/2005 | Schmoll | 141/144 |
| 2006/0113002 | A1 | * | 6/2006 | Nishino et al. | 141/144 |
| 2009/0178728 | A1 | * | 7/2009 | Cochran et al. | 141/39 |

FOREIGN PATENT DOCUMENTS

| | | | | | |
|---|---|---|---|---|---|
| EP | 0 515 960 | | | 12/1992 | |
| FR | 2 748 669 | | | 11/1997 | |
| GB | 2288168 | A | * | 10/1995 | B67C 3/20 |
| JP | 03069495 | A | * | 3/1991 | B67C 3/20 |
| JP | 06080196 | A | * | 3/1994 | B67C 3/20 |
| JP | 09002585 | A | * | 1/1997 | B67C 3/28 |
| JP | 11349097 | A | * | 12/1999 | B67C 3/28 |
| JP | 2001-219995 | A | | 8/2001 | |
| JP | 2001348002 | A | * | 12/2001 | B65B 3/36 |
| JP | 2003231590 | A | * | 8/2003 | B67C 3/28 |
| WO | WO 2005/080202 | | | 9/2005 | |

OTHER PUBLICATIONS

Oehler, Güther. "Volumetrische Abfuellung Mittels Magnetisch Induktiver Durchflussmesstechnik" Wagen and Dorsieren, Verlagsgesellschaft Keppler, Mainz, DE, Issue 27, Nr.5, Sep. 1996, pp. 15-18, 21. XP000627442.

* cited by examiner

METHOD OF OPERATING A BEVERAGE BOTTLING OR CONTAINER FILLING ARRANGEMENT WITH A FILLING VOLUME CORRECTING APPARATUS

CONTINUING APPLICATION DATA

This application is a Continuation-In-Part application of International Patent Application No. PCT/EP2007/005400, filed on Jun. 20, 2007, which claims priority from Federal Republic of Germany Patent Application No. 10 2006 029 490.4, filed on Jun. 27, 2006. International Patent Application No. PCT/EP2007/005400 was pending as of the filing date of this application. The United States was an elected state in International Patent Application No. PCT/EP2007/005400.

BACKGROUND

1. Technical Field

The present application relates to a method for the operation of a beverage bottling or container filling arrangement with a filling volume correcting apparatus.

2. Background Information

Background information is for informational purposes only and does not necessarily admit that subsequently mentioned information and publications are prior art.

Arrangements pertaining to the aseptic bottling of a liquid filling material into bottles, or the like containers are gaining increasingly in importance. Thus, it is often necessary or desired to fill a liquid filling material in a manner which is substantially aseptic, i.e., under clean room conditions (e.g., clean room class 100, according to US FED STD 209E cleanroom standards, or clean room class ISO 5, according to ISO 14644-1 cleanroom standards) into bottles, or the like containers; and it is necessary or desired, as well, subsequently then also to close such containers under clean room conditions, for instance, while bottling very sensitive drinks, or liquids, such as, for example, milk products, juices; or, however, when bottling of medicinal products, etc. The same requirements also apply to the filling, or bottling of products which are sensitive in terms of hygienic and microbiological considerations that need to be handled or should be handled under air conditions which are substantially low in terms of germs, as is the case, for example, with wine, beer, or fruit juices.

For the aseptic bottling there are basically known installations or arrangements which are configured to form, within a housing, a clean room space or region that is closed with respect to its surrounding outside, and that is supplied with filtered, sterile air; with a transport distance, or a transportation structure, or a conveying structure of defined distance of length that is configured for the movement of the containers, or bottles, which distance is extending through said clean room region; and being contiguous to the transport distance, within the clean room space area, there are disposed a rinser, a filling machine, as well as a closer that are disposed in succession along the conveying direction. Usually, this clean room space is further surrounded by a secure area or safe region, in which area or region there are then provided, among other things, arrangements that are configured to provide gate or passage means for the supply or the introduction of the empty containers which need to be or should be filled, or, respectively for the removal of the filled and closed containers.

Furthermore, there are known filling elements configured for filling of bottles or the like containers with a liquid filling material, also for the filling of bottles with various drinks or liquids, also in embodiments as filling elements that are configured for carrying out a volume-controlled filling (volumetric filling). In the case of such filling elements in a fluid conduit arrangement that is disposed between a source of the liquid filling material (e.g., storage container, or a kettle, or a boiler) and the respective filling element, there is provided a flow measuring device that is configured to deliver a measuring signal, or control signal—which is controlling, or effectuating the completion of the filling stage, i.e., the closing of the pertaining valve for the liquid—to a central control device (computer/calculator or processor) of the filling machine.

In order so as to maintain the described aseptic filling arrangements free of germs, it is, as described, necessary or desired to prevent, restrict, and/or minimize any type of ingress from the outside. Nevertheless, should it be required or desired to open the aseptic area, for instance, for carrying out necessary or desired repair work, then afterwards an intensive and protracted cleaning and disinfecting process of the entire area must or should occur. Therefore, any and even a very short opening of the area, for instance, in order to effectuate a repair, leads to economic losses which are even greater than the economic losses experienced in hitherto customary arrangements.

OBJECT OR OBJECTS

It is one possible object of the present application to improve filling plants or arrangements, for example for aseptic applications, that are configured in such a way that in the event of certain disturbances at least a temporary operation of the plant or arrangement remains possible, and without the need to carry out an immediate repair.

SUMMARY

The present application achieves this by way of a method for the control of a filling plant. The filling plant comprises a plurality of filling elements which can be controlled for operation and which filling elements comprise flow measuring devices. For the control of the opening time of a first filling element, the desired opening time to accommodate the throughput of the set volume of flow of at least one second filling element is measured by means of the flow measuring device that is provided at the at least one second filling element. The first filling element is opened for a period of time corresponding to the measured opening time.

The present application relates to a method for the control of a filling plant. The filling plant comprises a plurality of filling elements which can be controlled for operation and which filling elements comprise flow measuring devices.

In this way an arrangement in accordance with the present application can be operated in spite of a defect in a flow measuring device at a filling element without an immediate repair of the defective flow measuring device. By way of use of a pertaining opening time that is measured in virtual or actual manner at a second flow measuring device, a relatively reliable filling of the containers is also possible by way of the first, defective filling element. Also in the event of the often strongly changing actual operating conditions, for instance, as pertaining to the pressure of the filling material in the fluid conduit arrangements or introducing conduits, or in the event of changes in the speed of the filling plant in its entirety, the actual conditions, possibly in the vicinity of the defective filling element, are taken into consideration, so that pertaining divergences in the set filling volume are relatively low, and therefore the corresponding requirements with regard to the allowed divergences of the filling volumes can, in the event of a disturbance, be addressed.

Thus, a filling arrangement or plant can be operated for relatively long periods of time, essentially without its capacity decreasing, or that the number of the faulty fillings clearly increases. In this way, the necessary or desired exchange of the defective filling element or its faulty flow measuring device can be carried out at a specific time, such as during a scheduled disinfecting process of the entire filling arrangement becomes necessary or is desired, or such scheduled disinfecting process is prescribed. Thus, the necessary or desired down time of the entire arrangement is extended merely by the time required or desired for the actual exchange. In this manner, an additional shut down or, respectively, a start up of the entire arrangement or plant and the necessary or desired unscheduled disinfecting process can be avoided, restricted, and/or minimized.

Further embodiments are disclosed according to the present application.

Thus, it is possible, in the case of filling elements that rotate, to use as the second filling element that filling element that precedes the first filling element when considered in the direction of rotation or the direction of circulation.

In a customary construction style of filling plants, the filling elements are secured at a large circulating or rotating rotor which can also support a container for the filling material. Because the filling state or level inside of this container does considerably fluctuate over time and during operation there arise substantially strong spatial divergences in the interior of the container, the pertaining filling pressure that is applied at the pertaining filling elements—the pressure being dependent upon the position of the filling elements and the respective conditions as to time—is subject to very strong fluctuations or variations. Similar problems arise in the event that every filling element carries its own container for containment of the respective filling material.

In this manner of arrangement, it is advantageous to utilize that filling element which precedes, when considered in the direction of rotation, the defective flow measuring device for the determination of the necessary or desired opening time, because this preceding filling element, on account of the spatial proximity of the supply conduit arrangements with respect to the filling material container, is subjected to very similar conditions as the defective filling element. In this way it is possible to use the required or desired opening time relatively exactly more generally for the defective filling element.

Thus, the signal that is configured to provide for the open condition of the pertaining valve of the second filling element is applied to the first filling element, but with a delay that is equivalent to one filling position by the time of rotation which, in turn, is a function of the speed of the rotor. As soon as the set throughput volume has been measured in the preceding second filling element, by means of the flow measuring device that is provided thereat, the second filling element and the closing instruction, which are again retarded or delayed by the time of rotation, is transmitted also to the first filling element.

The method can possibly be applied in the event of a defect occurring with respect to the flow measuring device that is disposed at the first filling element.

In one possible embodiment according to the present application, it is possible, for the purpose of computing the necessary or desired opening time of the first filling element, to modify the measured opening time of the second filling element by a correction factor.

This correction factor can, for instance, consider stationary divergences or fluctuations of the flow-through speed of or at the first filling element and of or at the second filling element, which fluctuations can arise on account of the constructive or architectural circumstances.

In at least one possible embodiment, the opening times of the immediately or generally preceding filling stage, or of several preceding filling stages—which opening times are required or desired for the passage of the set flow-through volume—are stored in pertaining manner in reference to each filling element.

If the immediate or general use of the opening time of the second flow through element, which opening time is under certain circumstances modified by a correction factor, prove to not be sufficient, it is thus possible to draw further conclusions from the stored opening times with respect to the actual behavior of the machine, which conclusions result from the stored opening times and to utilize such data for the computation of the pertaining correction factor.

Hence, it can be appropriate that the correction factor is determined by evaluation of the stored opening time of the first filling element and the stored opening time of the second filling element.

For the realization of the functions described in the foregoing, there is provided at least one central computer unit or control unit or control arrangement, a further description of which is not included herein.

In addition, the present application refers to a control unit for the realization of the method in accordance with the present application as well as to a filling plant with a corresponding control unit.

The above-discussed embodiments of the present invention will be described further herein below. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The described and further advantages of the present application are illustrated in the following drawings. There is shown in.

DESCRIPTION OF EMBODIMENT OR EMBODIMENTS

Figure 1:
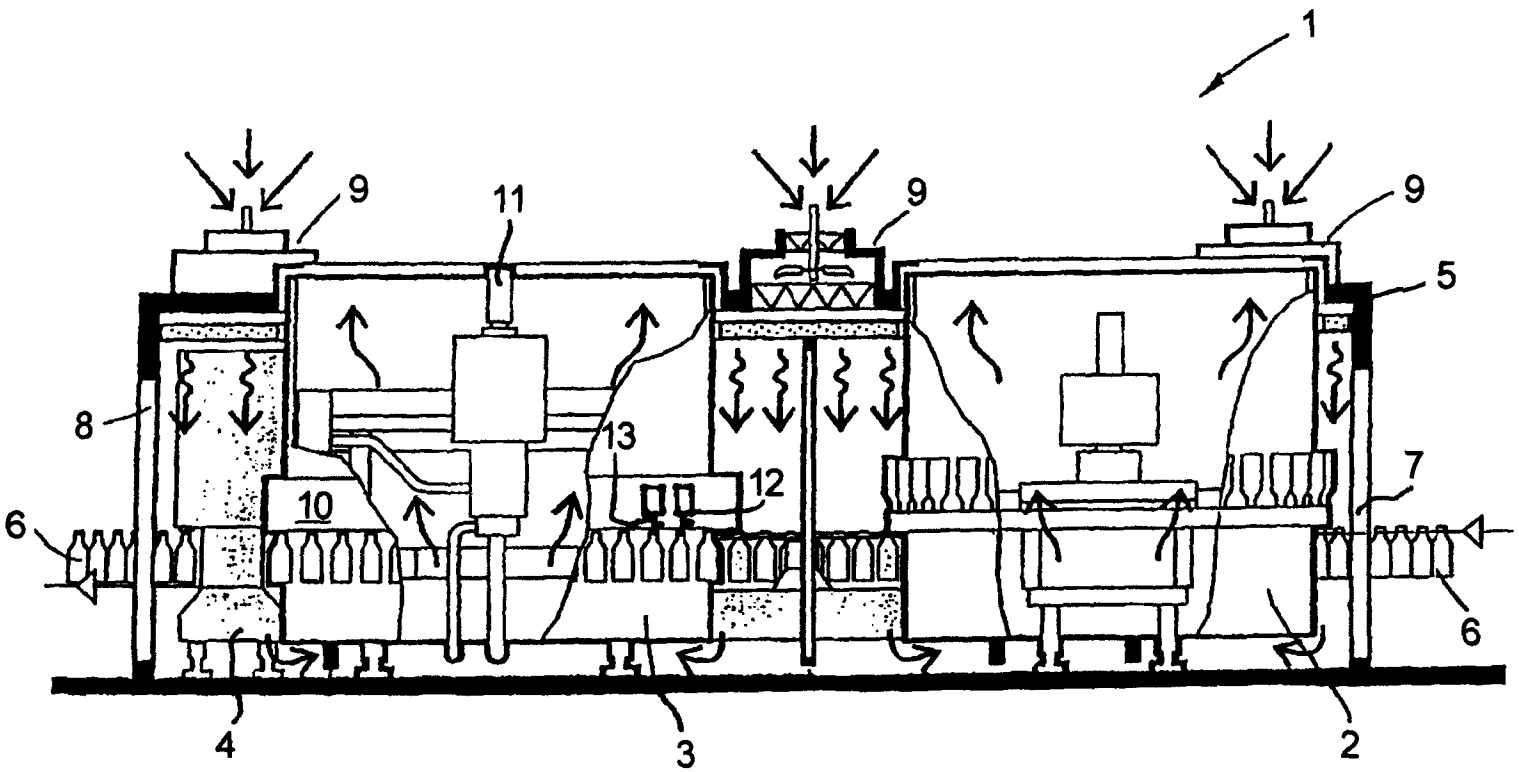
FIG. 1 a schematically shown side elevational view, partially shown in cross-section, of an aseptic filling arrangement or plant for use in conjunction with at least one possible embodiment.

In general, a filling distance, i.e. a distance of a filling arrangement configured for aseptic filling is shown in greater detail in FIG. 1 and is identified by reference numeral 1; and this filling distance is for the use with the control arrangement that is configured in accordance with the present application. Furthermore, there are provided, successively, a rinser 2, a filling plant or arrangement 3, and a closer 4, that are arranged in the interior of a self-contained or finished housing 5. Bottles 6 or the like containers are transported—by means of a conveyor device that is disposed on the one side—through an introducing arrangement or sluice arrangement 7 into the interior of the housing 5; and the bottles 6 are next, prior to filling thereof, rinsed once more by the rinser 2, and disinfected. Subsequently, the bottles 6 pass through the filling plant or arrangement 3 and upon filling they are provided with closures in the closer 4. Subsequently, the bottles 6 pass through a further sluice arrangement 8 by means of which they leave the aseptic housing 5.

For the supply of the interior of the aseptic arrangement with fresh air there are provided air introduction arrangements 9 by means of which the air, after having been rendered free of dust and germs, by means of filter mechanisms, not shown in greater detail herein, is brought to the inside of the arrangement.

The filling machine or arrangement 3 comprises a circulating rotor 10 which rotates about a vertical machine axis 11 due to being driven by means of a drive arrangement that is not shown in greater detail herein. Upon exiting from the rinser 2, the bottles 6 are received by the rotor 10 and they pass on an arcuate path through the filling machine or arrangement 3.

In the rotor 10 there are provided filling elements 21, and in one possible embodiment there is provided a first filling element 12 or a second filling element 13. The bottles pass through the filling machine 3 beneath filling openings of the filling elements 12, 13 and at the same rotating speed as the rotor 10. The filling elements 12, 13 are opened and the material to be filled drains into the bottles 6. Upon the necessary or desired amount of filling material having been dispensed, the filling elements 12, 13 are closed again and the bottles 6 are passed from the filling machine or arrangement 3 to the closer 4. Analogously this process applies to the filling of other containers, such as, for example, cans, cartons, bottles, multi-compartment bottles, etc.

Figure 2:
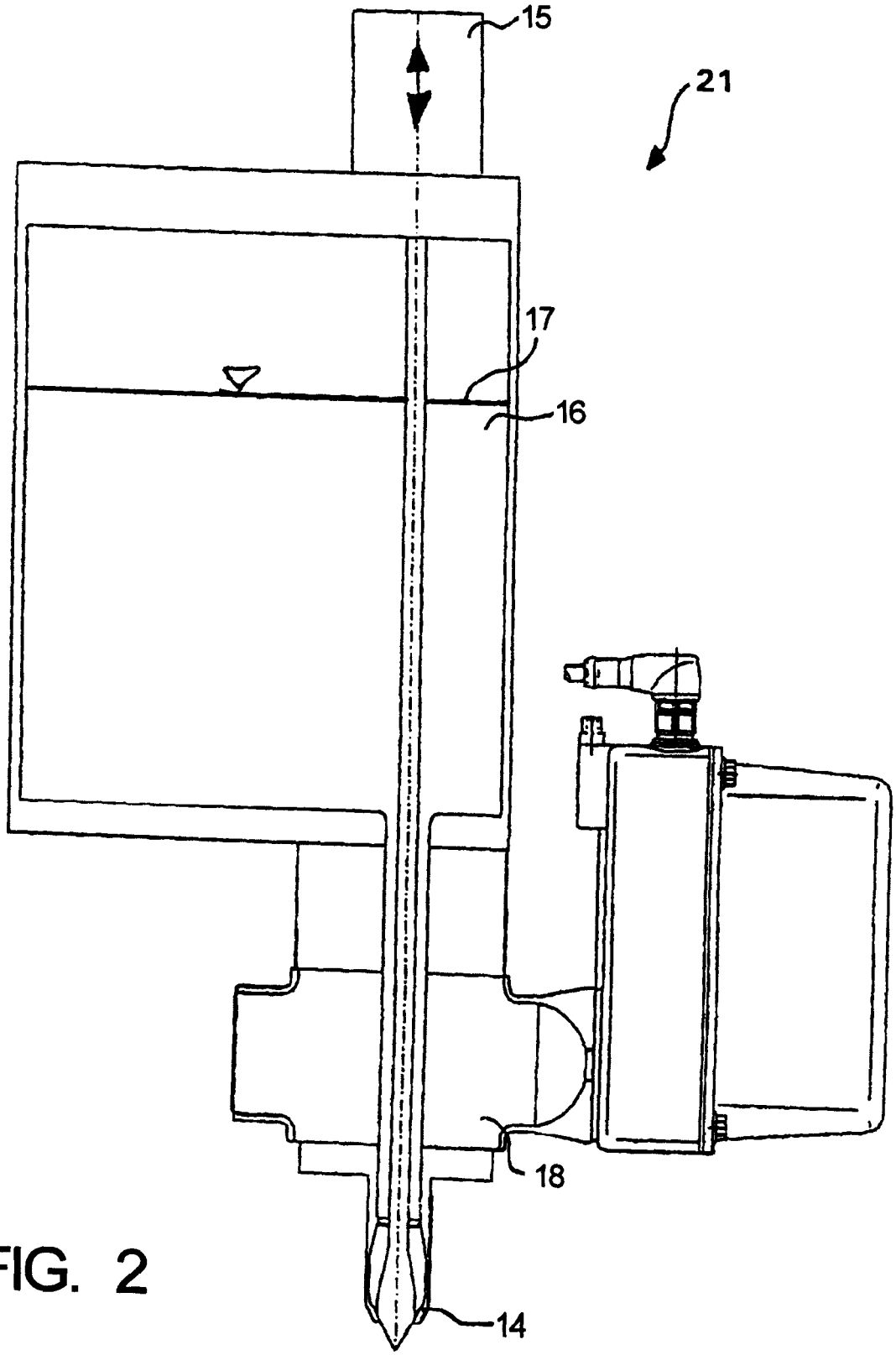
FIG. 2 a side elevational view, partially shown in cross-section, of a filling valve for use in conjunction with the present application.

The constructive features of a filling element 12, 13 are shown in greater detail in FIG. 2.

Such a filling element 12, 13 comprises at its lower terminus a filling valve 14 which can be opened or closed, for instance, by means of a rod of an electro-mechanical logic element 15. The material to be bottled, for instance, a beverage or a liquid medicinal product is container in a liquid container 16. The filling level or state 17 of the stock container 16 is a function of several factors, for instance, it is a function of the point of time since the last filling process, or it is a function of the rate of flow of the introducing system which delivers the material to be filled to the filling machine or arrangement 3, and this system is not shown in greater detail herein. On account of the constantly changing or intermittently changing liquid level 17, the filling pressure at the filling valve 14 is subject to wide fluctuations, so that the flow-through velocity and with it the time that is required or desired for the introduction of a certain filling amount into the bottle located underneath thereat is likewise fluctuating. In order to always attain or often attain, despite such fluctuations, a substantially constant filling amount in the bottles 6 that are to be filled, there is provided a magnetically inductive flow measuring device 18 that is configured to precisely determine or generally determine the amount of liquid passing through the valve 14.

To further explain, the flow measuring device 18 or flow meter may be utilized to monitor the liquid passing through the valve 14. A central control arrangement, such as a computer, is operatively connected to each of the flow meters 18 to receive measurement information regarding the flow of liquid. The control arrangement has programmed or stored therein data or information relating to desired or expected flow characteristics for the liquid being dispensed into the containers. The control arrangement, during operation of the filling machine, compares the data or information received from the flow meters 18 with stored data or information relating to desired or expected flow characteristics for the liquid. In this manner, errors in the operation of the flow meter 18 or the filling process may be easily detected. For example, if a flow meter 18 consistently sends data to the control arrangement that exceeds or is outside of an accepted range of values for that particular data, that it may be likely that the flow meter 18 is functioning erroneously and requires repair or replacement. Another example, the central control arrangement may not be receiving any information at all from a flow meter 18, which would be another indication of the flow meter 18 is not operating properly, if at all. Some examples of indicators of errors in the operation of a flow meter 18 may be as follows: a failure to send any data signals to the central control arrangement, dips or spikes below or beyond accepted or desired measurement ranges, and intermittent or interrupted transmission of data signals. In addition, the fluid or liquid being dispensed may have its own flow characteristics depending on the type of fluid or liquid. For example, water will have much different flow characteristics than other beverages, such as beer or orange juice. The different flow characteristics will produce different measurements during the opening or closing of the valve arrangement, and during the dispensing of the liquid when the valve arrangement is fully opened. Consequently, the central control arrangement may be programmed to recognize flow characteristics relating to the liquid being dispensed. In such an embodiment, the central control arrangement can compare stored data with new data received from the flow meters 18 to determine deviations in the measurements of the flow characteristics of the particular liquid. In addition, in at least one other possible embodiment, a central control arrangement can record and store data received from each individual flow meter 18. The control arrangement, during operation of the filling machine, can compare the stored data relating to a particular flow meter 18 with new data received from that flow meter. The control arrangement can then detect if there is a pattern of erroneous data measurements or a consistent or steady decrease in the accuracy of the data measurements been received from the flow meter 18. Therefore, the control arrangement may be programmed to monitor all or essentially all functions and data measurements of the flow meters 18 to determine if one or more flow meters 18 are functioning correctly.

The method in accordance with the present application comprises, at least in part, the following steps:

In the event that the flow-through measuring arrangement of the filling element 12 fails to operate or is operating erroneously, there arises, due to the greatly fluctuating machine parameters described herein, a lack in the precise or general determination of the amount of the filling material that is flowing through thereat. Due to this reason, the opening time of the leading filling element 13, when considered in the direction of rotation, is measured. This is the time that has elapsed beginning from the point of opening of the filling valve of the filling element 13 up to the point of its closing, with this opening time being determined by way of the properly operating or functioning flow measuring device 18 available thereat. Subsequently, then the filling valve of the filling element 12 is rendered open for the same duration, but with the commencement impulse being delayed by that period of time as is required or desired by the filling element 12 to be brought around by the rotor 10 to the same start position at which the filling valve 13 was upon commencement of its filling process.

From this it also arises that under certain circumstances both filling valves are respectively opened for an overlapping period of time, since the start impulse and the stop impulse of the properly working valve 13 are transferred with a delay to the defective, first filling element 12, with the delay being a function of the correspondingly required or desired time of rotation which is a function of the speed of the rotation of the rotor 10.

Because the defective first filling element 12 and the intact second filling element 13 are disposed in relatively close proximity with respect to one another, the conditions that are prevalent for each are relatively similar, so that the method described in the foregoing achieves a satisfactory filling also under use of the defective filling element 12. Exchange of the defective flow measuring device can then be carried out during the next following scheduled down time of the installation 1, since during such downtime a complete cleaning and disinfecting of the interior of the housing 5 needs to be or should be accomplished.

In the event that the described method should not provide sufficient filling results, the opening times of further filling elements, in one possible embodiment preceding filling elements, for example, by an averaging of data, can be included in the computation of the opening time for the defective filling element 12. Also static parameters that are used for the correction of the opening time are possible, for instance, on account of generally different flow through rates of the individual filling elements, as are caused by constructive or architectural circumstances; or, respectively, a shortening of the opening time by a certain amount, in order so as to achieve, an excessive filing of the container, or, respectively, a deficient filling of the container, depending on what is more sensible for the operation of the arrangement. Aside from the use of fixed factors for these values, it can be suitable, if the opening times or data in conformity therewith, of these filling elements or of all or most filling elements with functioning flow measuring devices are stored for a certain period of time and evaluated in pertaining manner.

In another possible embodiment, a weighting system can be used for measuring more than one filling element in order to determine the operating parameters for a defective filling element. For example, an algorithm could be utilized to calculate weighted values for each filling element depending on the distance that the filling elements are located from the defective filling element, since filling elements that are further away may be operating under different parameters, such as filling speeds, than filling elements that are closer to the defective filling element. Depending on the proximity to the defective filling element, one filling element could be given a higher or lower weighted value than another filling element. Such a weighting system could provide a more accurate measurement, and thus more accurate filling for the defective filling element.

The present application is naturally not limited to the foregoing embodiment, but can be changed in many ways without leaving the scope of the basic idea. Thus, the arrangement of the mentioned machines can be varied as well as the supplement with other types. The same applies to the used containers that are employed for the filling as well as the material to be filled. Not at last, the present application can generally also be employed in conventional, non-aseptic filling plants, so as to minimize down-times.

With the aid of a method for the control of a filling plant 3 which comprises a plurality of filling elements 12, 13 which can be controlled for operation and which filling elements comprise flow measuring devices 18, the operation of filling plants which are also suited for use under aseptic operating conditions is to be improved in such a way that also under the circumstances of certain disturbances at least a temporary operation of the pertaining plant remains as a possibility, without the requirement of an immediate repair.

This is attained thereby that for control of the opening time of a first filling element 12, the required or desired opening time to accommodate the throughput of the set volume of flow of at least one second filling element 13 is measured by means of the flow measuring device 18 that is provided at the at least one second filling element 13 and the first filling element 12 is opened for a period of time corresponding to the opening time that is measured at the at least one second filling element 13.

Figure 3:
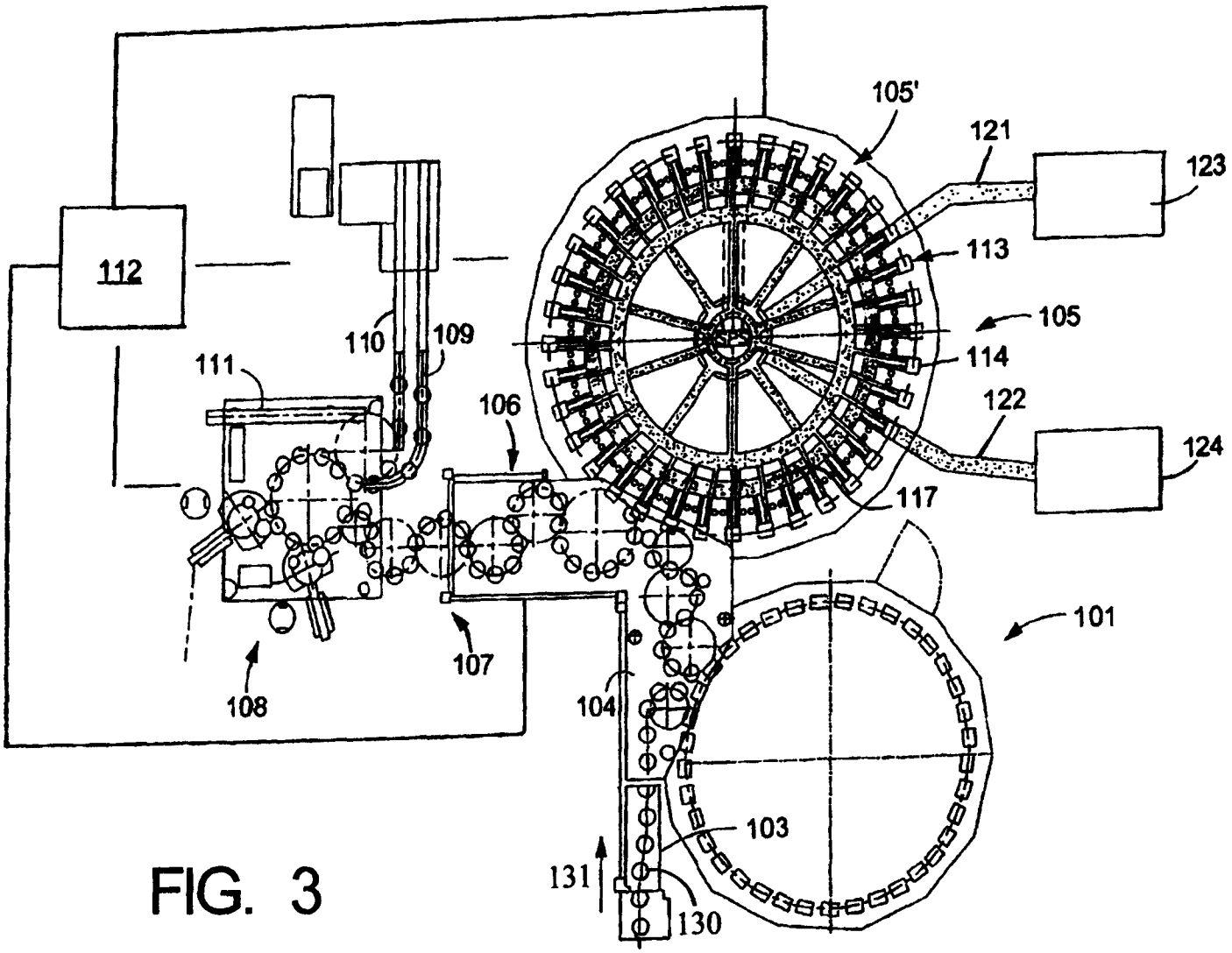
FIG. 3 shows schematically the main components of one possible embodiment example of a system for filling containers.

FIG. 3 shows schematically the main components of one possible embodiment example of a system for filling containers, specifically, a beverage bottling plant for filling bottles 130 with at least one liquid beverage, in accordance with at least one possible embodiment, in which system or plant could possibly be utilized at least one aspect, or several aspects, of the embodiments disclosed herein.

FIG. 3 shows a rinsing arrangement or rinsing station 101, to which the containers, namely bottles 130, are fed in the direction of travel as indicated by the arrow 131, by a first conveyer arrangement 103, which can be a linear conveyor or a combination of a linear conveyor and a starwheel. Downstream of the rinsing arrangement or rinsing station 101, in the direction of travel as indicated by the arrow 131, the rinsed bottles 130 are transported to a beverage filling machine 105 by a second conveyer arrangement 104 that is formed, for example, by one or more starwheels that introduce bottles 130 into the beverage filling machine 105.

The beverage filling machine 105 shown is of a revolving or rotary design, with a rotor 105', which revolves around a central, vertical machine axis. The rotor 105' is designed to receive and hold the bottles 130 for filling at a plurality of filling positions 113 located about the periphery of the rotor 105'. At each of the filling positions 103 is located a filling arrangement 114 having at least one filling device, element, apparatus, or valve. The filling arrangements 114 are designed to introduce a predetermined volume or amount of liquid beverage into the interior of the bottles 130 to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105'. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 3, there are two external supply reservoirs 123 and 124, each of which is configured to store either the same liquid beverage product or different products. These reservoirs 123, 124 are connected to the toroidal or annular vessel 117 by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each bottle 130, the first product or the second product can be filled by means of an appropriate control of the filling product or fluid valves.

Downstream of the beverage filling machine 105, in the direction of travel of the bottles 130, there can be a beverage bottle closing arrangement or closing station 106 which closes or caps the bottles 130. The beverage bottle closing arrangement or closing station 106 can be connected by a third conveyer arrangement 107 to a beverage bottle labeling arrangement or labeling station 108. The third conveyor arrangement may be formed, for example, by a plurality of starwheels, or may also include a linear conveyor device.

In the illustrated embodiment, the beverage bottle labeling arrangement or labeling station 108 has at least one labeling unit, device, or module, for applying labels to bottles 130. In the embodiment shown, the labeling arrangement 108 is connected by a starwheel conveyer structure to three output conveyer arrangements: a first output conveyer arrangement 109, a second output conveyer arrangement 110, and a third output conveyer arrangement 111, all of which convey filled, closed, and labeled bottles 130 to different locations.

The first output conveyer arrangement 109, in the embodiment shown, is designed to convey bottles 130 that are filled with a first type of liquid beverage supplied by, for example, the supply reservoir 123. The second output conveyer arrangement 110, in the embodiment shown, is designed to convey bottles 130 that are filled with a second type of liquid beverage supplied by, for example, the supply reservoir 124. The third output conveyer arrangement 111, in the embodiment shown, is designed to convey incorrectly labeled bottles 130. To further explain, the labeling arrangement 108 can comprise at least one beverage bottle inspection or monitoring device that inspects or monitors the location of labels on the bottles 130 to determine if the labels have been correctly placed or aligned on the bottles 130. The third output conveyer arrangement 111 removes any bottles 130 which have been incorrectly labeled as determined by the inspecting device.

The beverage bottling plant can be controlled by a central control arrangement 112, which could be, for example, computerized control system that monitors and controls the operation of the various stations and mechanisms of the beverage bottling plant.

One feature or aspect of an embodiment is believed at the time if the filing of this patent application to possibly reside broadly in a method for the control of a filling plant 3 which comprises a plurality of filling elements 12, 13 which can be controlled for operation and which filling elements comprise flow measuring devices 18, wherein for the control of the opening time of a first filling element 12 the desired opening time to accommodate the throughput of the set volume of flow of at least one second filling element 13 is measured by means of the flow measuring device 18 that is provided at the at least one second filling element 13 and the first filling element 12 is opened for a period of time corresponding to the measured opening time.

Another feature or aspect of an embodiment is believed at the time if the filing of this patent application to possibly reside broadly in the method, wherein the filling elements 12, 13 rotate and as the second filling element 13 there is used that filling element that precedes the first filling element 12 when considered in the direction of rotation.

Yet another feature or aspect of an embodiment is believed at the time if the filing of this patent application to possibly reside broadly in the method, wherein the method is performed in the case of a defect of the flow measuring device 18 of the first filling element 12.

Still another feature or aspect of an embodiment is believed at the time if the filing of this patent application to possibly reside broadly in the method, wherein for the calculation of the necessary or desired opening time of the first filling element 12, the measured opening time of the second filling element 13 is modified with a correction factor.

A further feature or aspect of an embodiment is believed at the time if the filing of this patent application to possibly reside broadly in the method, wherein the data corresponding to the opening times required or desired for the passage of the set volume of flow of the immediately or generally preceding filling stage or of several preceding filling stages for each filling element 12, 13 are stored.

Another feature or aspect of an embodiment is believed at the time if the filing of this patent application to possibly reside broadly in the method, wherein the correction factor is determined by way of evaluation of the stored data corresponding to the opening times of the first filling element 12 and of the second filling element 13.

Yet another feature or aspect of an embodiment is believed at the time if the filing of this patent application to possibly reside broadly in the method, wherein, in addition, there are measured the opening times of further filling elements 11 and the correction factor is determined by way of evaluation of the weighted averages of the measured opening times of the further filling elements 12, 13.

Still another feature or aspect of an embodiment is believed at the time if the filing of this patent application to possibly reside broadly in the method, wherein as flow measuring device 18 there are used magnetic-inductive measuring devices.

A further feature or aspect of an embodiment is believed at the time if the filing of this patent application to possibly reside broadly in the method, wherein as filling elements there are used valves which are configured to be operated electro-mechanically, and/or pneumatically, and/or hydraulically.

One feature or aspect of an embodiment is believed at the time if the filing of this patent application to possibly reside broadly in a control unit for the realization of a method according to the present application.

One feature or aspect of an embodiment is believed at the time if the filing of this patent application to possibly reside broadly in a filling plant with a control unit for the realization of a method according to the present application.

Another feature or aspect of an embodiment is believed at the time of the filing of this patent application to possibly reside broadly in a method of operating a beverage bottling arrangement, said method comprising the steps of: moving beverage bottles onto a rotor of a beverage bottle filling machine; filling each of the beverage bottles with a corresponding filling element, said step of filling comprising: opening a valve arrangement of said corresponding filling element; monitoring the flow of liquid beverage with a flow measuring device of said corresponding filling element; measuring the flow of liquid beverage with said flow measuring device and closing said valve arrangement upon a predetermined volume of liquid beverage flowing therethrough; and transmitting, from said flow measuring device to a control arrangement, data regarding the amount of time said valve arrangement is open sufficient to permit flow of the predetermined volume of liquid beverage; moving the filled beverage bottles out of the beverage bottle filling machine; moving filled beverage bottles into a beverage bottle closing machine; closing the filled beverage bottles; moving the closed beverage bottles out of the beverage bottle closing machine; detecting with said control arrangement at least one of: a failure of transmission of filling time data from a first flow measuring device of a first filling element; and transmission of filling time data from a first flow measuring device of a first filling element, which filling time data deviates substantially from filling time data stored in said control arrangement or from filling time data transmitted from at least a second flow measuring arrangement; detecting with said control arrangement correct data transmitted from at least a second flow measuring device disposed adjacent and preceding said first flow measuring device in the direction of rotation of said rotor of said beverage bottle filling machine; and controlling the opening and closing of said valve arrangement of said first filling element according to the amount of time said valve arrangement of said at least a second flow measuring device is open sufficient to permit flow of the predetermined volume of liquid beverage.

Yet another feature or aspect of an embodiment is believed at the time of the filing of this patent application to possibly reside broadly in the beverage bottling arrangement, comprising: a first moving arrangement being configured to move beverage bottles onto a rotor of a beverage bottle filling machine; filling elements being configured to fill each of the beverage bottles, said filling elements comprising: a valve arrangement being configured to be opened to permit flow of liquid beverage; a flow measuring device being configured to monitor the flow of liquid beverage; said flow measuring device being configured to measure the flow of liquid beverage and to close said valve arrangement upon a predetermined volume of liquid beverage flowing therethrough; and said flow measuring device being configured to transmit, to a control arrangement, data regarding the amount of time said valve arrangement is open sufficient to permit flow of the predetermined volume of liquid beverage; a second moving arrangement being configured to move the filled beverage bottles out of the beverage bottle filling machine; a third moving arrangement being configured to move filled beverage bottles into a beverage bottle closing machine; closing arrangements being configured to close the filled beverage bottles; a fourth moving arrangement being configured to move the closed beverage bottles out of the beverage bottle closing machine; said control arrangement being configured to detect erroneous time transmitted from a first flow measuring device of a first filling element; said control arrangement being configured to detect correct data transmitted from at least a second flow measuring device disposed adjacent and preceding said first flow measuring device in the direction of rotation of said rotor of said beverage bottle filling machine; and said control arrangement being configured to control the opening and closing of said valve arrangement of said first filling element according to the amount of time said valve arrangement of said at least a second flow measuring device is open sufficient to permit flow of the predetermined volume of liquid beverage.

Still another feature or aspect of an embodiment is believed at the time of the filing of this patent application to possibly reside broadly in a method of operating a container filling arrangement, said method comprising the steps of: moving containers onto a rotor of a container filling machine; filling each of the containers with a corresponding filling element, said step of filling comprising: opening a valve arrangement of said corresponding filling element; monitoring the flow of a liquid with a flow measuring device of said corresponding filling element; measuring the flow of liquid with said flow measuring device and closing said valve arrangement upon a predetermined volume of liquid flowing therethrough; and transmitting, from said flow measuring device to a control arrangement, data regarding the flow of the predetermined volume of liquid; moving the filled containers out of the container filling machine; moving filled containers into a container closing machine; closing the filled containers; moving the closed containers out of the container closing machine; detecting with said control arrangement erroneous data transmitted from a first flow measuring device of a first filling element; detecting with said control arrangement data transmitted from at least a second flow measuring device preceding said first flow measuring device in the direction of rotation of said rotor, which said at least a second flow measuring device is sufficiently close to said first flow measuring device to provide data for said first flow measuring device to fill the container being filled by said first filling element with sufficient accuracy; and controlling the operation of said first filling element according to the data transmitted from said at least a second flow measuring device.

A further feature or aspect of an embodiment is believed at the time of the filing of this patent application to possibly reside broadly in the container filling arrangement, comprising: a first moving arrangement being configured to move containers onto a rotor of a container filling machine; filling elements being configured to fill each of the containers, said filling elements comprising: a valve arrangement being configured to be opened to permit flow of liquid; a flow measuring device being configured to monitor the flow of liquid; said flow measuring device being configured to measure the flow of liquid and to close said valve arrangement upon a predetermined volume of liquid flowing therethrough; and said flow measuring device being configured to transmit, to a control arrangement, data regarding the flow of the predetermined volume of liquid; a second moving arrangement being configured to move the filled containers out of the container filling machine; a third moving arrangement being configured to move filled containers into a container closing machine; closing arrangements being configured to close the filled containers; a fourth moving arrangement being configured to move the closed containers out of the container closing machine; said control arrangement being configured to detect erroneous data transmitted from a first flow measuring device of a first filling element; said control arrangement being configured to detect data transmitted from at least a second flow measuring device nearest said first flow measuring device; and said control arrangement being configured to control the operation of said first filling element according to the correct data transmitted from said at least a second flow measuring device.

Another feature or aspect of an embodiment is believed at the time of the filing of this patent application to possibly reside broadly in the means for performing the method of operating a container filling arrangement, said means comprising: means for moving containers onto a rotor of a container filling machine; means for filling each of the containers, said means for filling comprising: means for opening a valve arrangement; means for monitoring and measuring the flow of liquid, and for closing said valve arrangement upon a predetermined volume of liquid flowing therethrough; and means for transmitting data regarding the flow of the predetermined volume of liquid; means for moving the filled containers out of the container filling machine; means for moving filled containers into a container closing machine; means for closing the filled containers; means for moving the closed containers out of the container closing machine; and means for detecting erroneous data transmitted from a first flow measuring means of a first filling means, and for detecting data transmitted from at least a second flow measuring means nearest said first flow measuring means, and for controlling the operation of said first filling means according to the correct data transmitted from said at least a second flow measuring means.

Yet another feature or aspect of an embodiment is believed at the time of the filing of this patent application to possibly reside broadly in a method of operating a container filling arrangement, said method comprising the steps of: moving containers onto a rotor of a container filling machine; filling each of the containers with a corresponding filling element, said step of filling comprising: opening a valve arrangement of said corresponding filling element; monitoring the flow of liquid with a flow measuring device of said corresponding filling element; measuring the flow of liquid with said flow measuring device and closing said valve arrangement upon a predetermined volume of liquid flowing therethrough; and transmitting, from said flow measuring device to a control arrangement, data regarding the flow of the predetermined volume of liquid; moving the filled containers out of the container filling machine; moving filled containers into a container closing machine; closing the filled containers; moving the closed containers out of the container closing machine; comparing, with said control arrangement, data transmitted from at least a first flow measuring device and a second flow measuring device; and operating said first flow measuring device according to the data transmitted from said second flow measuring device.

Still another feature or aspect of an embodiment is believed at the time of the filing of this patent application to possibly reside broadly in the container filling arrangement, said container filling arrangement comprising: a first moving arrangement being configured to move containers onto a rotor of a container filling machine; filling elements being configured to fill each of the containers, said filling elements comprising: a valve arrangement being configured to be opened to permit flow of liquid; a flow measuring device being configured to monitor the flow of liquid; said flow measuring device being configured to measure the flow of liquid and to close said valve arrangement upon a predetermined volume of liquid flowing therethrough; and said flow measuring device being configured to transmit, to a control arrangement, data regarding the flow of the predetermined volume of liquid; a second moving arrangement being configured to move the filled containers out of the container filling machine; a third moving arrangement being configured to move filled containers into a container closing machine; closing arrangements being configured to close the filled containers; a fourth moving arrangement being configured to move the closed containers out of the container closing machine; said control arrangement being configured to compare data transmitted from at least a first flow measuring device and a second flow measuring device; and said control arrangement being configured to operate said first flow measuring device according to the data transmitted from said second flow measuring device.

A further feature or aspect of an embodiment is believed at the time of the filing of this patent application to possibly reside broadly in the means for performing the method of operating a container filling arrangement, said means comprising: means for filling each of the containers, said means for filling comprising: means for opening a valve arrangement; means for monitoring and measuring the flow of liquid, and for closing said valve arrangement upon a predetermined volume of liquid flowing therethrough; and means for transmitting data regarding the flow of the predetermined volume of liquid; means for moving the filled containers out of the container filling machine; means for moving filled containers into a container closing machine; means for closing the filled containers; means for moving the closed containers out of the container closing machine; and means for comparing data transmitted from at least a first flow monitoring means and a second flow monitoring means, and for operating said first flow monitoring means according to the data transmitted from said second flow monitoring means.

Another feature or aspect of an embodiment is believed at the time of the filing of this patent application to possibly reside broadly in a method of operating a beverage bottling arrangement, said method comprising the steps of: moving beverage bottles onto a rotor of a beverage bottle filling machine; filling each of the beverage bottles with a corresponding filling element, said step of filling comprising: opening a valve arrangement of said corresponding filling element; monitoring the flow of liquid beverage with a flow measuring device of said corresponding filling element; measuring the flow of liquid beverage with said flow measuring device and closing said valve arrangement upon a predetermined volume of liquid beverage flowing therethrough; and transmitting, from said flow measuring device to a control arrangement, data regarding the amount of time said valve arrangement is open sufficient to permit flow of the predetermined volume of liquid beverage; moving the filled beverage bottles out of the beverage bottle filling machine; moving filled beverage bottles into a beverage bottle closing machine; closing the filled beverage bottles; moving the closed beverage bottles out of the beverage bottle closing machine; detecting with said control arrangement erroneous data transmitted from a first flow measuring device of a first filling element; detecting with said control arrangement correct data transmitted from at least a second flow measuring device disposed adjacent and preceding said first flow measuring device in the direction of rotation of said rotor of said beverage bottle filling machine; and controlling the opening and closing of said valve arrangement of said first filling element according to the amount of time said valve arrangement of said at least a second flow measuring device is open sufficient to permit flow of the predetermined volume of liquid beverage.

Yet another feature or aspect of an embodiment is believed at the time of the filing of this patent application to possibly reside broadly in a method of operating a container filling arrangement, said method comprising the steps of: moving containers onto a rotor of a container filling machine; filling each of the containers with a corresponding filling element, said step of filling comprising: opening a valve arrangement of said corresponding filling element; monitoring the flow of a liquid with a flow measuring device of said corresponding filling element; measuring the flow of liquid with said flow measuring device and closing said valve arrangement upon a predetermined volume of liquid flowing therethrough; and transmitting, from said flow measuring device to a control arrangement, data regarding the flow of the predetermined volume of liquid; moving the filled containers out of the container filling machine; moving filled containers into a container closing machine; closing the filled containers; moving the closed containers out of the container closing machine; detecting with said control arrangement erroneous data transmitted from a first flow measuring device of a first filling element; detecting with said control arrangement correct data transmitted from at least a second flow measuring device nearest said first flow measuring device; and controlling the operation of said first filling element according to the correct data transmitted from said at least a second flow measuring device.

The components disclosed in the various publications, disclosed or incorporated by reference herein, may possibly be used in possible embodiments of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications and publications recited herein, and in the Declaration attached hereto, are hereby incorporated by reference as if set forth in their entirety herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

All of the patents, patent applications or patent publications, which were cited in the International Search Report dated Oct. 9, 2007, and/or cited elsewhere are hereby incorporated by reference as if set forth in their entirety herein as follows: EP 0515960, having the following English translation of the German title "METHOD AND APPARATUS FOR FILLING CONTAINERS," published on Dec. 2, 1992; WO 2005/080202, having the title "FILLING MACHINE WITH TIME-CONTROLLED DOSING VALVES," published on Sep. 1, 2005; FR 2,748,669, having the following English translation of the French title "BALL FOR A BALL GAME, PARTICULARLY BOULES," published on Nov. 21, 1997; and "VOLUMETRISCHE ABFUELLUNG MITTELS MAGNETISCH INDUKTIVER DURCH-FLUSSMESSTECHNIK," by Mainz KEPPLER, vol. 27, no. 5, published by Wagen und Dosieren, in September 1996.

Some examples of weighting systems and uses of weighting systems that may possibly be utilized or adapted for use in at least one possible embodiment may possibly be found in the following U.S. Pat. No. 5,490,489 issued to Mayer, et al. on Feb. 13, 1996; U.S. Pat. No. 4,128,829 issued to Herbst, et al. on Dec. 5, 1978; U.S. Pat. No. 4,417,248 issued to Mathews on Nov. 22, 1983; U.S. Pat. No. 5,983,251 issued to Martens, et al. on Nov. 9, 1999; U.S. Pat. No. 7,343,222 issued to Solomon on Mar. 11, 2008; and U.S. Pat. No. 6,794,728 issued to Kithil on Sep. 21, 2004.

Some examples of bottling and container handling systems and components thereof which may possibly be utilized or adapted for use in at least one possible embodiment, may possibly be found in the following U.S. Pat. No. 6,484,477, entitled "Capping Machine for Capping and Closing Containers, and a Method for Closing Containers;" U.S. Pat. No. 6,474,368, entitled "Beverage Container Filling Machine, and Method for Filling Containers with a Liquid Filling Material in a Beverage Container Filling Machine;" U.S. Pat. No. 6,494,238, entitled "A Plant for Filling Beverage into Beverage Bottles Other Beverage Containers Having Apparatus for Replacing Remaining Air Volume in Filled Beverage Bottles or Other Beverage Containers;" U.S. Pat. No. 6,470,922, entitled "Apparatus for the Recovery of an Inert Gas;" U.S. Pat. No. 6,463,964, entitled "Method of Operating a Plant for Filling Bottles, Cans or the like Beverage Containers with a Beverage, and a Beverage Container Filling Machine;" U.S. Pat. No. 6,834,473, entitled "Bottling Plant and Method of Operating a Bottling Plant and a Bottling Plant with Sections for Stabilizing the Bottled Product;" U.S. Pat. No. 6,484,762, entitled "A Filling System with Post-dripping Prevention;" U.S. Pat. No. 6,668,877, entitled "Filling System for Still Beverages;" U.S. Pat. No. 7,024,841, entitled "Labeling Machine with a Sleeve Mechanism for Preparing and Applying Cylindrical Labels onto Beverage Bottles and Other Beverage Containers in a Beverage Container Filling Plant;" U.S. Pat. No. 6,971,219 entitled "Beverage bottling plant for filling bottles with a liquid beverage filling material and a labelling station for labelling filled bottles and other containers;" U.S. Pat. No. 6,973,767, entitled "Beverage bottling plant and a conveyor arrangement for transporting packages;" U.S. Pat. No. 7,013,624, entitled "Beverage bottling plant for filling bottles with a liquid beverage filling material, a container filling plant container information adding station, such as, a labeling station, configured to add information to containers, such as, bottles and cans, and modules for labeling stations;" U.S. Pat. No. 7,108,025, entitled "Beverage Bottling Plant for Filling Bottles with a Liquid Beverage Filling Material, and a Container Filling Lifting Device for Pressing Containers to Container Filling Machines;" U.S. Pat. No. 7,062,894, entitled "Beverage Bottling Plant for Filling Bottles with a Liquid Beverage Filling Material, and a Container Filling Plant Container Information Adding Station, Such As, a Labeling Station Having a Sleeve Label Cutting Arrangement, Configured to Add Information to Containers, Such As, Bottles and Cans;" U.S. Pat. No. 7,010,900, entitled "Beverage Bottling Plant for Filling Bottles with a Liquid Beverage Filling Material, and a Cleaning Device for Cleaning Bottles in a Beverage Bottling Plant;" U.S. Pat. No. 6,918,417, entitled "A Beverage Bottling Plant for Filling Bottles with a Liquid Beverage Filling Material, and an Easily Cleaned Lifting Device in a Beverage Bottling Plant;" U.S. Pat. No. 7,065,938, entitled "A Beverage Bottling Plant for Filling Bottles with a Liquid Beverage Filling Material, and a Container Filling Plant Container Information Adding Station, Such As, a Labeling Station Having a Gripper Arrangement, Configured to Add Information to Containers, Such As, Bottles and Cans;" U.S. Pat. No. 6,901,720, entitled "A Beverage Bottling Plant for Filling Bottles with a Liquid Beverage Filling Material, and Apparatus for Attaching Carrying Grips to Containers with Filled Bottles;" and U.S. Pat. No. 7,121,062 "Beverage bottling plant for filling bottles with a liquid beverage filling material, having a container handling machine with interchangeable receptacles for the container mouth."

The purpose of incorporating U.S. patents, Foreign patents, publications, etc. is solely to provide additional information relating to technical features of one or more embodiments, which information may not be completely disclosed in the wording in the pages of this application. Words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned words in this sentence, when not used to describe technical features of one or more embodiments, are not considered to be incorporated by reference herein.

The corresponding foreign and international patent publication applications, namely, Federal Republic of Germany Patent Application No. 10 2006 029 490.4, filed on Jun. 27, 2006, having inventors Karl LORENZ and Achim KUNZ, and DE-OS 10 2006 029 490.4 and 10 2006 029 490.4, and International Application No. PCT/EP2007/005400, filed on Jun. 20, 2007, having WIPO Publication No. WO2008/000375 and inventors Karl LORENZ and Achim KUNZ, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

The purpose of incorporating the Foreign equivalent patent application PCT/EP2007/005400 and German Patent Application 10 2006 029 490.4 is solely for the purpose of providing a basis of correction of any wording in the pages of the present application, which may have been mistranslated or misinterpreted by the translator. Words relating to opinions and judgments of the author and not directly relating to the technical details of the description of the embodiments therein are not to be incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned word in this sentence, when not used to describe technical features of one or more embodiments, are not generally considered to be incorporated by reference herein.

Statements made in the original foreign patent applications PCT/EP2007/005400 and DE 10 2006 029 490.4 from which this patent application claims priority which do not have to do with the correction of the translation in this patent application are not to be included in this patent application in the incorporation by reference.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

AT LEAST PARTIAL NOMENCLATURE

1 filling distance
2 rinser
3 filling plant
4 closer
5 housing
6 bottles
7 sluice
8 sluice
9 air introduction arrangements
10 rotor
11 vertical machine axis
12 first filling element
13 second filling elements
14 filling valve
15 electro-mechanical logic element
16 liquid containers
17 filling level
18 flow measuring device

What is claimed is:

1. A method of controlling a container filling machine, which said filling machine comprises a plurality of filling elements, each comprising a flow measuring device, said method comprising the steps of:

opening a first filling element and thereby dispensing a predetermined volume of filling material into a first container, and then closing said first filling element upon said flow measuring device detecting that said predetermined volume of filling material is dispensed, while measuring the time that said first filling element is open to dispense said predetermined volume of filling material; and opening a second filling element for essentially said measured time that said first filling element was open to dispense said predetermined volume of filling material, and thereby dispensing essentially said predetermined volume of filling material into a second container, only upon malfunction or failure of said flow measuring device of said second filling element.

2. The method according to claim 1, wherein said container filling machine comprises a rotatable rotor on which said filling elements are mounted, and said first filling element precedes said second filling element in the direction of rotation of said rotor.

3. The method according to claim 2, further comprising calculating a time for said second filling element to be open by modifying said measured time with a correction factor.

4. The method according to claim 3, further comprising storing times that said second filling element and said first filling element are open of one or more filling cycles preceding said step of calculating said time for said second filling element to be open, and then determining said correction factor by evaluating said stored times of said second filling element and said first filling element.

5. The method according to claim 4, wherein said flow measuring devices are magnetic-inductive measuring devices.

6. The method according to claim 5, wherein each of said filling elements comprises valves configured to be operated electro-mechanically, and/or pneumatically, and/or hydraulically, and said filling machine is an aseptic filling machine.

7. A method of controlling a container filling machine, which said filling machine comprises a plurality of filling elements, each comprising a flow measuring device, said method comprising the steps of:

opening a plurality of filling elements and thereby dispensing a predetermined volume of filling material from each filling element into its corresponding container, and then closing each filling element upon its flow measuring device detecting that said predetermined volume of filling material is dispensed, while measuring the time that each filling element is open to dispense said predetermined volume of filling material;

calculating a time based on said measured times that each filling element was open to dispense said predetermined volume of filling material; and opening another filling element for essentially said calculated time and thereby dispensing essentially said predetermined volume of filling material into another container, only upon malfunction or failure of said flow measuring device of said another filling element.

8. The method according to claim 7, wherein said container filling machine comprises a rotatable rotor on which said filling elements are mounted, and said plurality of filling elements precede said another filling element in the direction of rotation of said rotor.

9. The method according to claim 8, further comprising calculating a time for said another filling element to be open by modifying said average time with a correction factor.

10. The method according to claim 9, further comprising storing said times that said another filling element and said plurality of filling elements are open of one or more filling cycles preceding said step of calculating said time for said another filling element to be open, and then determining said correction factor by evaluating said stored times of said another filling element and said plurality of filling elements.

11. The method according to claim 10, wherein said flow measuring devices are magnetic-inductive measuring devices.

12. The method according to claim 11, wherein each of said filling elements comprises valves configured to be operated electro-mechanically, and/or pneumatically, and/or hydraulically, and said filling machine is an aseptic filling machine.

* * * * *